US005079862A

United States Patent [19]

McMahan et al.

[11] Patent Number: 5,079,862

[45] Date of Patent: Jan. 14, 1992

[54] TUBULAR MAGAZINE LOADING APPARATUS

[76] Inventors: Robert M. McMahan, 8301 Port Haven Dr.; John F. Bertsch, Jr., 132 Leisure Ct., both of Sidney, Ohio 45365

[21] Appl. No.: 687,805

[22] Filed: Apr. 19, 1991

[51] Int. Cl.[5] ..... F41A 9/82

[52] U.S. Cl. ..... 42/87; 221/83

[58] Field of Search ..... 42/87-89; 206/3; 221/69, 76, 82, 83

[56] References Cited

U.S. PATENT DOCUMENTS

| | | | |
|---|---|---|---|
| 49,523 | 8/1865 | Howlett . | |
| 871,355 | 11/1907 | Morlan . | |
| 1,647,788 | 11/1927 | Dinspel . | |
| 2,508,820 | 5/1950 | Fraley | 42/87 |
| 2,573,003 | 10/1951 | Fraley | 42/88 |
| 2,833,080 | 5/1958 | Hess et al. | 43/55 |
| 3,757,449 | 9/1973 | Schindler | 42/87 |
| 4,121,365 | 10/1978 | Hodil | 42/88 |

*Primary Examiner*—Charles T. Jordan

*Attorney, Agent, or Firm*—Biebel & French

[57] ABSTRACT

An apparatus is disclosed for storing and dispensing cartridges into the tubular magazine of a .22 caliber or other such rifle. The apparatus includes a central chamber section having a central passageway extending therethrough with a plurality of storage passageways radially spaced equidistant from the central passage and equidistant from each other. An upper cap and a lower cap are spring loaded against opposite ends of the chamber by way of a tension spring passing through the central chamber. The upper cap includes a dispensing opening radially aligned with the plurality of dispensing passages. The outer periphery of the dispensing chamber includes a plurality of semi-cylindrical grooves and the inner periphery of the cap includes two detent rib for positioning in the various semi-cylindrical grooves of the chamber. The cap is movable into positions where the dispensing passage in the cap is angularly aligned with one of the passages, and also into locked positions where the dispensing passage in the cap is positioned intermediate to adjacent dispensing passages in the chamber.

14 Claims, 4 Drawing Sheets

TUBULAR MAGAZINE LOADING APPARATUS

FIELD OF THE INVENTION

The subject invention relates to an apparatus for storing and dispensing cartridges into magazines of tubular magazined rifles.

DESCRIPTION OF THE PRIOR ART

With long barrelled rifles, such as 0.22 caliber rifles, cartridges are generally purchased in boxes or cartons, where the cartridges are disposed in several stacked rows. While this method is quite useful and standard for storage purposes, the loading of the rifle's tubular magazine becomes quite difficult and time consuming, if the cartridges are loaded into the rifle magazine directly from the box. Either when plinking or when in rifle competition, the speed of reloading the rifle magazine is vital to the success of the sport. It is desirable then in such applications to have dispensing and storage mechanisms for speed loading the magazine of such rifles.

For example, in U.S. Pat. No. 3,757,449, a loading apparatus is disclosed where individual tubes are glued to a central post and to each other. The lower end of the individual tubes can be closed off by way of individual plugs glued within the tube ends, or by way of a cap fixed to their ends. An upper cap is held to the assembled tubes by a screw fastened to the central post. While the principle disclosed in the above-mentioned application is sound, there are several drawbacks to this specific design. First, there is a relatively large number of component parts for assembly, such that the assembly of such an item would be quite labor-intensive, with resultant high cost. Second, with so many individual components, the collective costs of the components would make the assembled product cost prohibitive. Third, the upper cap is held to the assembled tubes by way of a screw, and turning the cap in a clockwise sense could tend to tighten the screw whereas turning the cap in a counterclockwise sense could tend to loosen the screw, and thus the security of the cap may need to be checked periodically to assure that it is adequately attached to the assembly.

Thus, one object of the invention is to provide a magazine loading apparatus which is easily manufacturable, and which consists of a relative few number of parts, such that the unit is inexpensive to manufacture and not labor-intensive to assemble.

Another object of the invention is to provide a durable magazine loading apparatus which is rugged, and will not become disassembled in normal use.

Another object of the invention is to provide a magazine loading apparatus which has detent positions maintaining the apparatus in a locked open position, for dispensing the cartridges, and having an alternative locked closed position preventing the inadvertent spillage of the cartridges.

Other objects and advantages of the invention will be apparent from the following description, the accompanying drawings and the appended claims.

SUMMARY OF THE INVENTION

The objects of the invention were accomplished by providing a chamber assembly for dispensing cartridges, where the assembly comprises an integral chamber housing having a first end and a second end, and a plurality of bores extending through the chamber housing between the first and second ends, each bore being positioned radially equidistant from an axial centerline. The chamber housing also includes a central elongate passageway extending along the axial centerline between the ends. The assembly further includes an upper dispensing cap disposed over the first end, where the dispensing cap has a dispensing opening therethrough radially positioned for alignment with one of the bores upon rotation of the dispensing cap. A closure cap is also disposed over the lower end of the housing member. A tension spring is disposed in the central bore and is attached to both the dispensing cap and the closure cap to retain them to the ends of the housing.

In this manner, by connecting the end caps together through the center of the housing member by way of a spring, the two end caps are held fast to the ends of the housing member.

In the preferred embodiment, the upper cap is detented into open and closed positions by two inner detent ribs being disposed in axially extending grooves along the outer periphery of the housing. The spring loading conveniently allows the upper cap to be axially movable against the spring load, and subsequently rotated until the dispensing opening is aligned with a selected one of the bores, whereupon the upper cap is released and the upper detent ribs are disposed in another selected groove.

DETAILED DESCRIPTION OF THE PREFERRED EMBODIMENT

Figure 1:
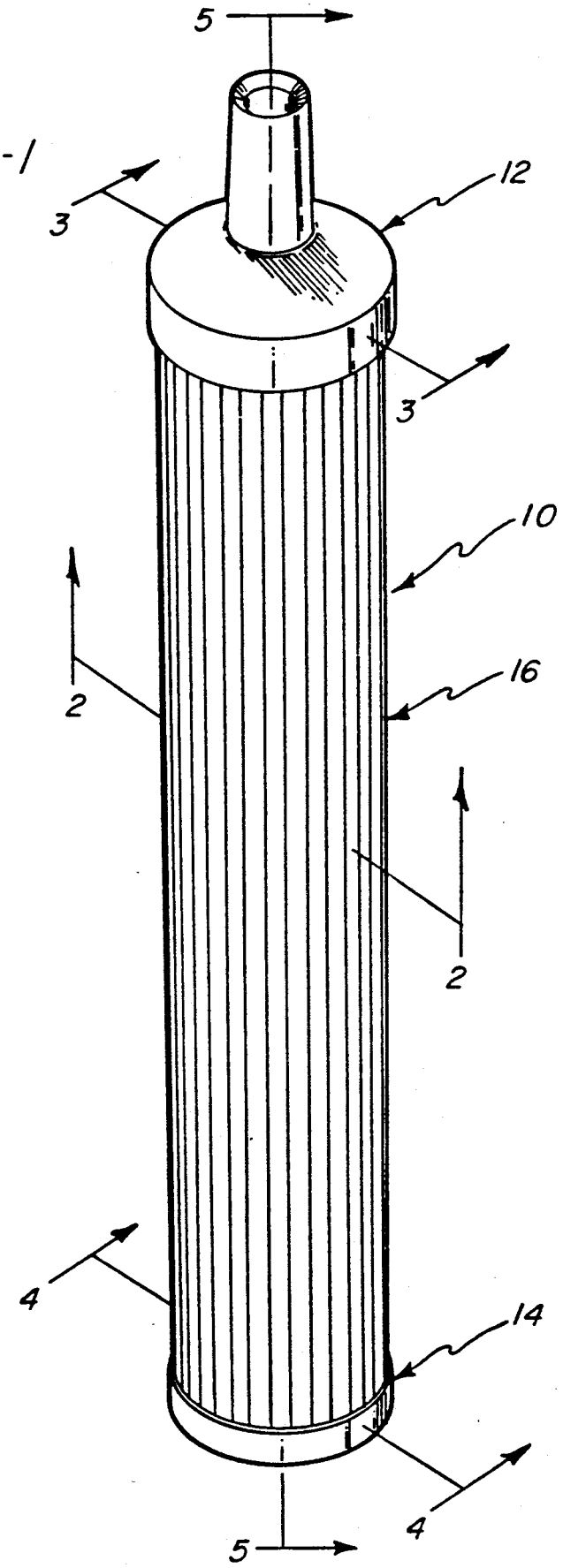
FIG. 1 is a perspective view of the magazine loading mechanism in accordance with the preferred embodiment of the invention.

With reference first to FIG. 1, a loading apparatus is shown for storing, and later dispensing cartridges into a rifle magazine. In the preferred embodiment of the invention, the loading apparatus 10 is specifically designed for a 0.22 caliber rifle, although it should be appreciated that the size of the various components could be changed to accommodate other ranges of rifle sizes. The magazine loading mechanism is shown generally at 10 and comprises an upper cap member 12, a lower cap member 14 and a central chamber housing 16.

Figure 3:
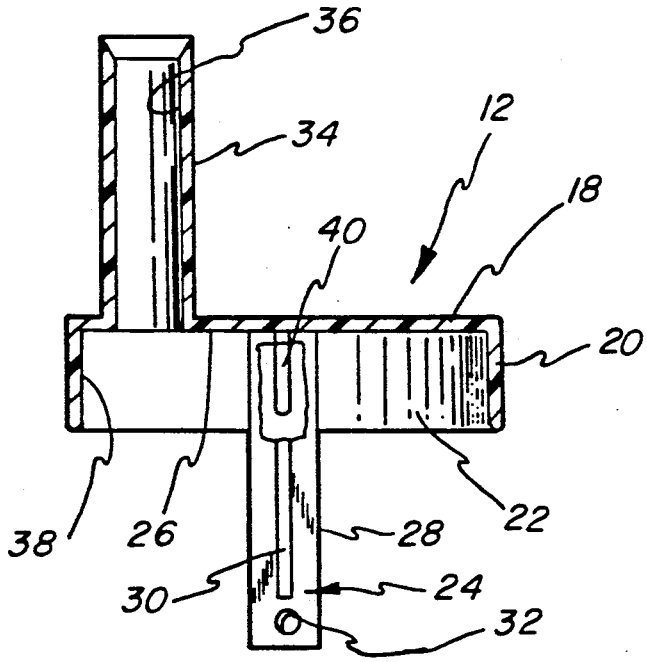
FIG. 3 is a cross-sectional view of the upper end cap taken along lines 3—3 of FIG. 1.

With reference first to FIG. 3, the upper cap 12 is shown in greater detail. The upper cap 12 is a molded plastic piece and includes a cylindrical disc section 18 having an annular skirt 20 extending downwardly therefrom, thereby forming an inner annular recess 22. A cross-shaped post 24 extends integrally from an inner surface 26 of the disc 18 including a main rib 28 and a cross rib 30. An aperture 32 extends through the main rib 28 proximate to the free end thereof. A dispensing column 34 extends upwardly from the cylindrical disc 18 and includes an upper opening at 36 for dispensing the cartridges where the opening 36 communicates with the inner annular recess 22. The peripheral skirt 20 includes an inner annular surface 38 having two diametrically opposed alignment ribs 40, the purpose for which will be described in greater detail herein.

Figure 4:
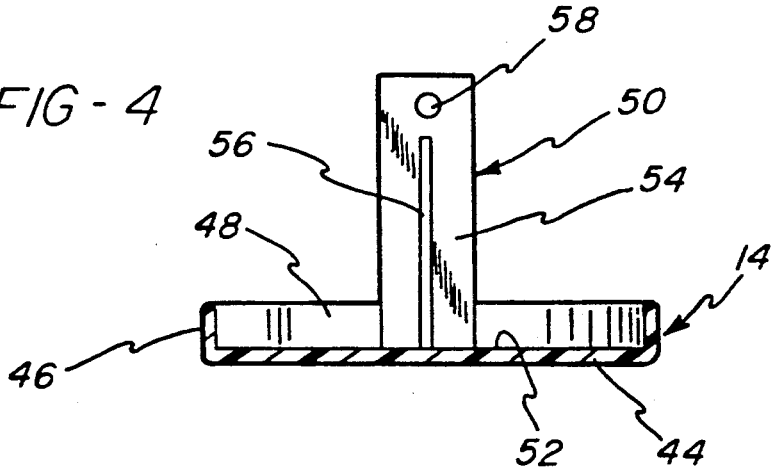
FIG. 4 is a cross-sectional view of the lower end cap taken along lines 4—4 of FIG. 1.

With reference now to FIG. 4, the lower cap 14 is similar in design to the upper cap 12 comprising a cylindrical disc section 44 having a peripheral skirt 46 thereby forming an inner annular recess 48. A cross-shaped post 50 extends integrally from an inner surface 52 of the disc 44. The post 50 includes a main post section 54 and a cross post section 56 with the main post section 54 including an aperture 58 proximate to its free end.

Figure 2:
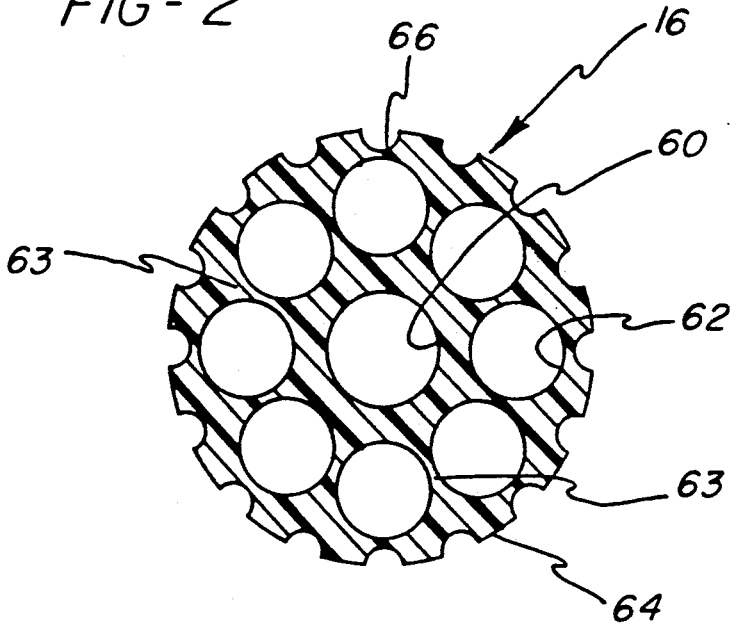
FIG. 2 is an instantaneous cross-sectional view taken along lines 2—2 of FIG. 1.

With reference now to FIG. 2, the central chamber housing 16 is shown in greater detail. The chamber housing 16 includes a central bore 60 having a plurality of storage bores 62 radially spaced equidistantly from the central bore 60 and spaced from each other in equal angular intervals. Each of the bores is discrete, being separated by an integral web of plastic material 63. The chamber housing 16 further includes an outer peripheral surface 64 having a plurality of semi-cylindrical grooves 66 extending the length of the housing 16. It should be noted from FIG. 2 that there is one groove 66 radially aligned with each passageway 62, and one groove 66 positioned intermediate adjacent passages 62, aligned with each web 63. In a preferred embodiment of the invention, the chamber housing 16 is extruded as a single unit comprising all features of FIG. 2, from a clear plastic material such as PVC, such that the chamber housing is transparent in order that the inner bores 62 are visible from the exterior, to determine whether such bores contain cartridges.

Figure 5:
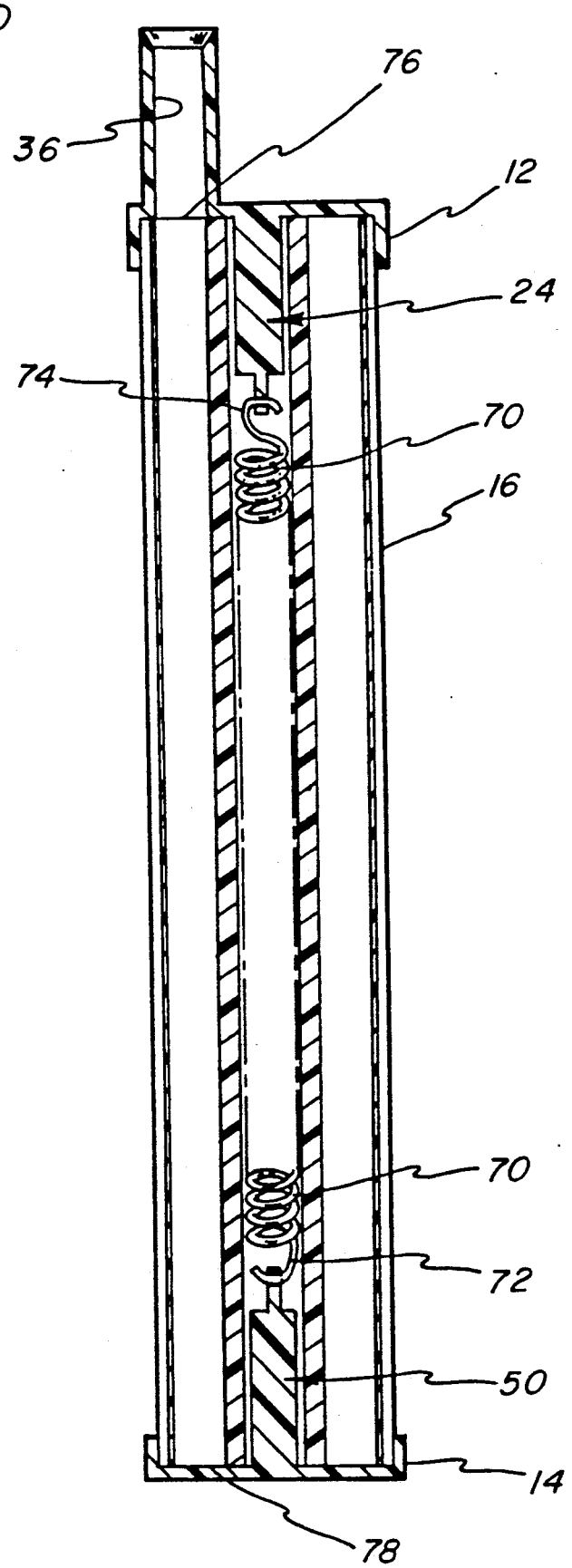
FIG. 5 is a cross-sectional view taken along lines 5—5 of FIG. 1.

As shown in FIG. 5, the loading apparatus 10 (FIG. 1) further comprises a tension spring 70 having hooks 72 and 74 at opposite ends. The apparatus is assembled by positioning spring hook 72 in the aperture 58 (FIG. 4) of the lower cap member 14. The spring 70 and post section 50 are then inserted into the central bore 60 of the chamber housing 16. The opposite end of the spring can be grasped by hook 74 and pulled outwardly, while the spring hook 74 is positioned in aperture 32 of the upper cap portion 12. The spring is then allowed to relax which positions the end caps in abutment with upper and lower surfaces 76 and 78 of the chamber member 16. It should be appreciated that when in the relaxed position, as shown in FIG. 5, the spring 70 is still in slight tension, maintaining the end caps 12, 14 in secure abutment against respective end walls 76, 78 of the chamber housing 16.

Figure 6:
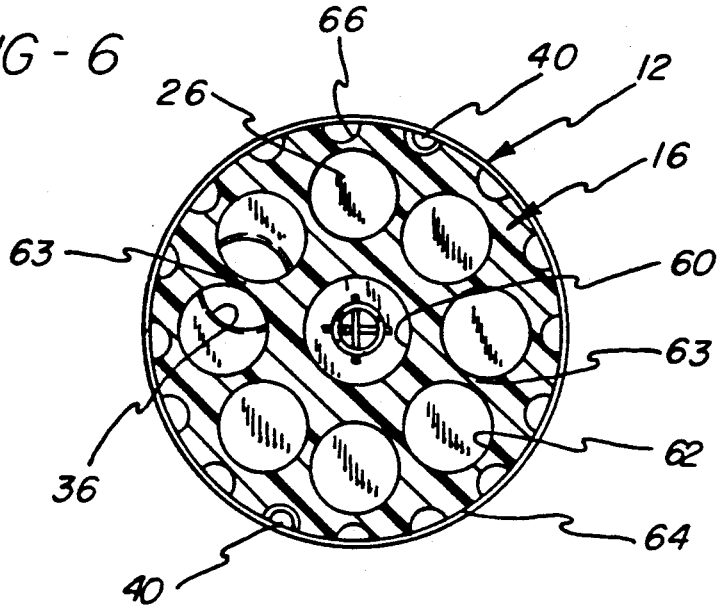
FIG. 6 is a cross-sectional view similar to that of FIG. 2 showing the upper end cap in view.

As shown in FIG. 6, the detent ribs 40 are radially aligned with two of the semi-cylindrical grooves 66 and is thereby prevented from rotation in either sense. As shown in FIG. 6, the upper cap 12 is shown in a locked position where one of the webs 63 is positioned intermediate the dispensing passage 36 thereby preventing discharge of the cartridges upon inversion of the assembled dispensing unit 10. It should also be appreciated that to align the dispensing passage 36 with one of the passages 62 as shown in FIG. 5, the upper cap is merely lifted under spring tension until such time as the detent ribs 40 clear the central chamber portion 16 and the upper cap 12 is rotated to the selected bore 62 to be either filled or dispensed.

As described above then, the apparatus 10 is useful for storing and, later, dispensing such cartridges as 0.22 caliber rifle cartridges. To load the apparatus, the upper cap is rotated to align the opening 36 with one of the bores 62, whereupon the cartridges are inserted through the opening 36, and stacked one above the other in the bore 62. The upper cap is repeatedly rotated into alignment with each empty bore 62 until such time as the chamber housing 16 is full. The cap 12 is thereafter rotated into the position shown in FIG. 6, to retain the cartridges in their respective bores, as the cartridges in each of the bores are retained in place against the inner surface 26 of the upper cap 12. To dispense the cartridges in any given bore 62, the cap 12 is lifted and rotated to align the opening 36 with one of the bores 62, and the apparatus can then be aligned with the rifle magazine and inverted to dispense a column of cartridges into the rifle magazine.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A chamber assembly for storing and dispensing cartridges, comprising:

a discrete chamber housing having a first end and a second end, a plurality of bores extending through said chamber housing between said first and second ends, each bore being positioned radially equidistant from a central axial centerline, a central elongate passageway extending along said central axis between said ends;

an upper dispensing cap disposed over said first end of said chamber housing, said dispensing cap having a dispensing opening therethrough radially positioned for alignment with one of said dispensing bores upon rotation of said dispensing cap;

a lower closure cap disposed over said lower end of said housing member; and a tension spring disposed in said central passageway attached to said dispensing cap and closure cap to retain said caps to said housing.

2. A dispensing chamber according to claim 1, wherein said chamber housing is a discrete item of extruded plastic material.

3. A dispensing chamber according to claim 2, wherein said chamber housing is transparent.

4. A dispensing chamber according to claim 2, wherein said chamber housing includes extruded axially extending grooves on said outer peripheral surface of said chamber housing, with one groove radially aligned with each bore, and with one groove intermediate each pair of adjacent bores.

5. A dispensing chamber according to claim 4, wherein said dispensing cap includes at least one detent rib adapted for alignment with any one of said grooves for detented positioning of said dispensing cap.

6. A dispensing chamber according to claim 5, wherein said dispensing cap is axially movable away from said housing under tension of said spring, to reposition said detent rib with another of said grooves.

7. A dispensing chamber according to claim 5, wherein said upper and lower caps are defined by a cylindrical disc having a peripheral skirt extending therefrom, said peripheral skirts being adapted to overlie said outer peripheral surface of said chamber housing at said first and second end.

8. A dispensing chamber according to claim 7, wherein said dispensing cap includes two diametrically opposed detent ribs positioned on an inner peripheral surface of said upper peripheral skirt.

9. A chamber assembly for storing and dispensing cartridges, comprising:

an elongate discrete central chamber housing having a first and second end, and a plurality of bores extending between said first and second ends, said bores being positioned radially equidistantly from a central axial centerline, and said elongate discrete central chamber housing having a plurality of grooves positioned of an exterior peripheral surface of said elongate discrete central chamber housing, each said bore having a groove radially aligned therewith, and each pair of adjacent bores having a groove positioned medially therebetween;

an upper cap member spring loadably mounted to said elongate discrete central chamber housing and rotatable relative thereto, said elongate discrete central chamber housing having a dispensing opening positioned radially for alignment with one of said plurality of bores upon rotation of said cap member, said upper cap member including a peripheral skirt adapted to overlie said elongate discrete central chamber housing, said peripheral skirt including at least one detent rib on an inner periphery thereof adapted to slide axially into selected grooves for alignment of said dispensing opening with said bore; and 10. A dispensing chamber in accordance with claim 9, wherein said chamber housing includes a passageway extending through said chamber housing along said axial centerline.

11. A dispensing chamber in accordance with claim 10, wherein a tension spring is disposed in said axial passageway, and said spring is connected at opposite ends to said upper cap and said end cap, spring loading said caps against ends of said housing chamber.

12. A dispensing chamber in accordance with claim 11, wherein said upper cap and end cap include an integral post disposed in said passageway, and said tension spring includes hooks extending through apertures in said posts.

13. A dispensing chamber in accordance with claim 9, wherein said chamber housing is extruded plastic material.

14. A dispensing chamber in accordance with claim 13, wherein said chamber housing is transparent plastic material.

* * * * *

UNITED STATES PATENT AND TRADEMARK OFFICE

CERTIFICATE OF CORRECTION

PATENT NO. : 5,079,862

DATED : January 14, 1992

INVENTOR(S) : Robert Michael McMahan and John Franklin Bertsch, Jr.

It is certified that error appears in the above-identified patent and that said Letters Patent is hereby corrected as shown below:

Column 5, claim 9, line 9, "positioned of" should be --positioned on--.

Column 6, claim 9, after line 2, add paragraph --an end cap positioned over said second end.--

Column 6, claim 11, line 12, "housing chamber" should be --chamber housing--.

Signed and Sealed this

Twenty-third Day of March, 1993

*Attest:*

STEPHEN G. KUNIN

*Attesting Officer*

*Acting Commissioner of Patents and Trademarks*